US005125654A

United States Patent [19]

Bruno

[11] Patent Number: 5,125,654

[45] Date of Patent: Jun. 30, 1992

[54] TENNIS BALL RETRIEVING SYSTEM

[75] Inventor: Wilbert Bruno, Rodgau, Fed. Rep. of Germany

[73] Assignee: Transita Vertriebs - und Handelsgesellschaft mbH, Offenbach, Fed. Rep. of Germany

[21] Appl. No.: 572,084

[22] Filed: Aug. 24, 1990

[51] Int. Cl.[5] ..... A63B 69/40

[52] U.S. Cl. ..... 273/29 A

[58] Field of Search ..... 273/29 R, 176 FA, 181 H, 273/182 R, 182 A; 294/19.1, 19.2

[56] References Cited

U.S. PATENT DOCUMENTS

| | | | |
|---|---|---|---|
| 3,184,239 | 5/1965 | Heuser | 273/176 FA |
| 3,203,696 | 8/1965 | Sawyer | 273/29 A |
| 4,004,806 | 1/1977 | Malik | 273/29 R |
| 4,215,865 | 8/1980 | Pilati | 273/176 FA |
| 4,606,543 | 8/1986 | Hartland | 273/29 A |
| 4,938,479 | 7/1990 | Jenkins et al. | 273/29 A |

FOREIGN PATENT DOCUMENTS

| | | | |
|---|---|---|---|
| 0029821 | 3/1986 | France | 273/29 A |
| 8204813 | 7/1984 | Netherlands . | |

*Primary Examiner*—Theatrice Brown

[57] ABSTRACT

The invention comprises a ball retrieval arm mechanism extending from the base line to the tennis net on a tennis court and can be moved along the net. During the retrieving process, the retrieving arm moves only one time during each passage in a transverse direction over one half of the tennis court. The retrieving arm continues its movement until it reaches one side edge of the tennis court. Ball receiving channels are provided along both sides of the tennis court, into one of which the balls are thrust by the retrieving arms and transported by conveyor belts to one top end of the tennis court. The ball receiving channels have connections to a conveyor chute by which the balls are transported from the corners of the tennis court to a ball retriever placed in the middle of the top of the tennis court or to a ball retriever directly. The retrieving arm is preferably guided only at one end thereof by a guide rail extending along the top of the tennis court. A constant alignment of the retrieving arm transverse to the net and the guide rail is provided by a sensor scanning the angle between the retrieving arm and guide rail. The sensor controls electric motors driving traveling wheels of the retrieving arm to maintain a correct angle. A ball throwing machine is provided, the ball throwing machines preferably have wheels which can be automatically raised and lowered alternately to allow the retrieving arm to pass therebeneath. The ball retriever is selectively connected to the ball throwing machine or another ball receiving container.

9 Claims, 3 Drawing Sheets

Fig. 1
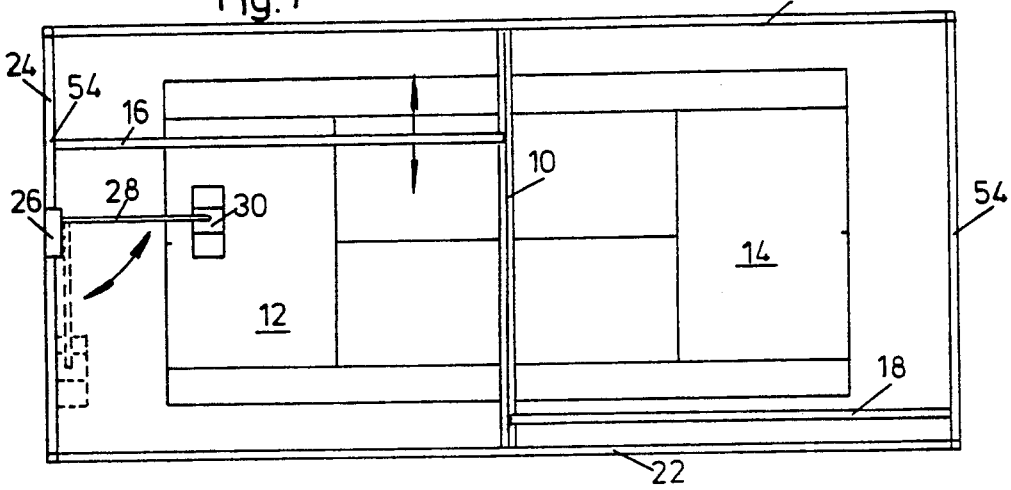
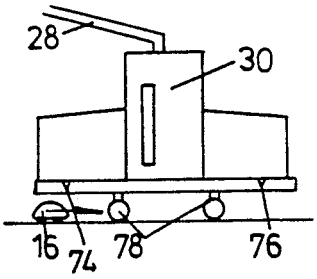
Fig. 5a
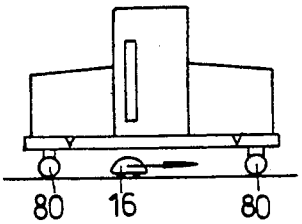
Fig. 5b
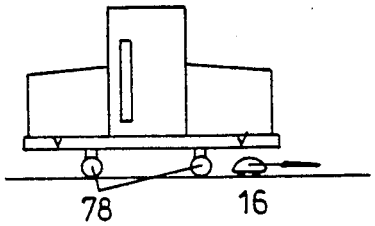
Fig. 5c
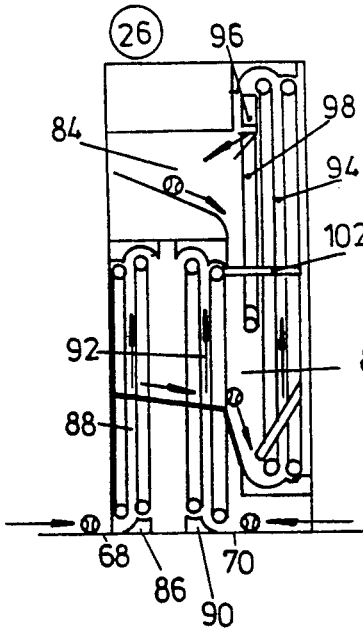
Fig. 6
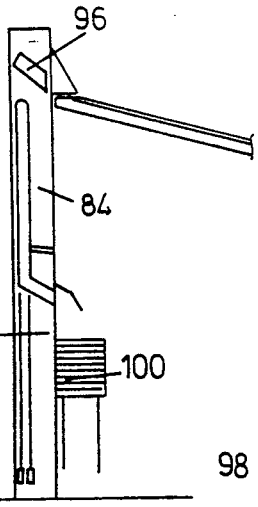
Fig. 7
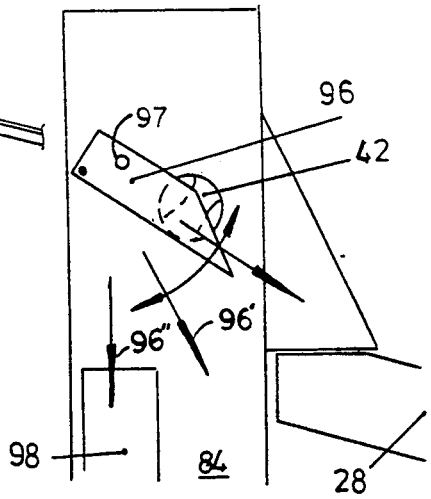
Fig. 8

TENNIS BALL RETRIEVING SYSTEM

FIELD OF THE INVENTION

The invention relates to a system for retrieving tennis balls with a retrieving arm which can be moved transverse to its longitudinal axis over the surface of one half of a tennis court provided with net.

BACKGROUND INVENTION

When many balls are used while practicing tennis for training purposes, the process of retrieving or collecting the balls represents an interruption of the playing and training process which can be undesirable for many reasons. Especially when a ball throwing machine is used for the training of one or more tennis players, and the ball throwing machine throws out a number of balls in a short time, the process of retrieving the balls is very lengthy in proportion to the effective training time. This increases the relative expenditure for the training particularly when the ball throwing machine and/or the tennis court is rented out per time unit, particularly by the hour. From that point of view, the process of ball retrieval is undesirable, because it represents lost training time.

For that reason ball retrieval systems with a movable retrieving arm are already known, which are intended to simplify the retrieval or collection of the tennis balls. In a first known embodiment as disclosed by German Offenlegungsschrift 32 42 358, the retrieving arm extends in the starting position along the side of the tennis court and can be swiveled around approximately 90° into a position extending along the rear edge of the court for retrieval and collection of the balls lying on the court. The basic drawback of this construction lies in that a swivelable retrieving arm cannot sweep over the entire surface of one half of a tennis court and also the border areas.

In another known retrieval system, as disclosed in U.S. Pat. No. 4,456,252 and U.S. Pat. No. 4,606,543, a retrieving arm is provided which extends parallel to the net, is approximately the same length as the net and can be moved for the retrieval and collection of the balls in longitudinal direction along the tennis court to its rear border. There the retrieving arm thrusts the balls onto a ball receiving channel extending along the tennis court rear border, which transports them by means of a conveyor belt or by dropping into a ball collection container.

The system of U.S. Pat. No. 4,456,262 suffers from the imperfection that the retrieving arm does not rest on the border of the tennis court during the training but rather rests on or at the net in the middle of the tennis court. That is irritating, because the players often run forward up to the net and then cannot concentrate solely on the ball, but rather must also pay attention that they do not run into the retrieving arm. Also, each operation of the retrieving arm requires considerable time, because it must be returned to its original position at the net following retrieval of the balls each time before the training can be resumed once again. During practice the retrieving arm cannot be moved at all, even when no person is found in the relevant half of the tennis court, because the retrieving arm of this arrangement and direction of movement is not in the position to convey the balls falling to the ground between said retrieving arm and the net into the ball receiving channel at the end of the tennis court. No ball receiving channel can be arranged under the net and also the balls thrust therein by the retrieving arm are gathered up only with difficulty.

As a retrieving arm which is movable lengthwise to the tennis court cannot remain at the net during training, in accordance with U.S. Pat. No. 4,606,543 the retrieving arm has its starting position at the top of the tennis court lying opposite the ball receiving channel and during the collection of the balls it must move back and forth over the entire length of the tennis court. The interruption of training for that purpose in this case lasts even as much as twice as long as with a system according to U.S. Pat. No. 4,456,252. Also the retrieving arm must be sufficiently short that it can pass through between the posts supporting the net, so that at the side edges of the tennis court tennis balls lying outside the posts cannot be collected.

SUMMARY OF THE INVENTION

Therefore the object of the invention is to provide a system of the aforementioned type by means of which essentially all of the tennis balls lying in one half of a tennis court are retrieved by a retrieving arm which in its starting position does not cause any disturbance during training or play, in which this retrieving process can also take place during practice and the retrieving arm need carry out only one single movement for that purpose.

The present object is attained according to the invention in that on at least one half of the tennis court the retrieving arm extends transverse to the net and can be moved along the net.

With the proposed system, during a retrieving process the retrieving arm moves only one time during each passage in transverse direction over one half of the tennis court. In doing this it also sweeps over the side area lying adjacent to the net posts. After each process of retrieval the retrieving arm then continues its movement until it reaches one side edge and does not move back to the opposite side edge until the next process of retrieval. If persons are found only on one half of the playing area of the tennis court, and a ball throwing machine plays out tennis balls from the other half of the tennis court, then on the side of the ball throwing machine the retrieving arm can move continuously back and forth during training. Thus, the retrieving arm can retrieve and collect balls which have fallen down on this half of the tennis court, so that they can be fed back again to the ball throwing machine and this machine can shoot out balls for a longer time without interruption.

Retrieving arms are preferably provided on both halves of the tennis court playing area and ball receiving channels extend along both sides of the tennis court. The balls which are thrust into the receiving channels by the retrieving arms are transported by means of conveyor belts to the one top end of the tennis court. There the ball receiving channels have connections to a conveyor chute or trough preferably provided with two conveyor belts, in which the balls are transported from the corners of the tennis court to a ball retriever placed in the middle of the top of the tennis court.

The retrieving arms are preferably guided in turn only at their one end to a guide rail extending along the top of the tennis court. A constant or uniform alignment of the retrieving arms transverse to the net and the guide rails is guaranteed preferably by a sensor scanning the angle between retrieving arm and guide rail. In the case wherein a retrieving arm begins to go askew, the sensor controls some plurality of the electric motors driving traveling wheels of the retrieving arm causing them to move with different velocity, so that a correct angle is established again between the retrieving arm and the guide rail. Also the orientation of the retrieving arms can be controlled so that their drive motors are not disconnected until the retrieving arm engages along its entire length on the ball receiving channel into which it has thrust all of the balls following a retrieving process. With such a guide of the retrieving arms, guide rails are no longer needed under the net. Instead, a shallow metal or plastic profile can be laid out on the ground having the same domed shape in cross section. The profile directs the balls dropping directly down the net a little bit away from the net, so that they are certain to be picked up by one of the retrieving arms and be thrust to one of the side ball receiving channels.

It is advantageous if a ball throwing machine launches the ball from the base line. When the ball throwing machine is standing there on the playing area of the tennis court, it would normally prevent a retrieving arm from sweeping over the entire surface of this half of the tennis court. In order to avoid complicated and costly support constructions for mounting and stabilization of the ball throwing machine (for instance on a side wall or on a ceiling of a tennis court hall), a further preferred embodiment of the invention provides that the ball throwing machine have wheels or feet which can be automatically raised and lowered alternately at some distance from each other as well as sensors scanning the position of the retrieving arm. The sensors then control the raising and lowering of the wheels or feet so that the retrieving arm can pass through under the ball throwing machine.

In order to be able to operate the system according to the invention with a great number of balls and in a simple manner to control whether all of the balls are still present after an hour of practice, in a further preferred embodiment of the invention an intermediate storage place for balls is arranged in the ball retriever. The intermediate storage place then can be connected by a vertical conveyor with a deflector selectively to an auxiliary tube of a ball throwing machine or to at least one further ball receiving container. Then a ball counter or recorder need only be arranged on the deflector, so that one can count both the balls being fed into the ball throwing machine and also all of the balls at the end of an hour of practice. If these balls are conveyed from the intermediate storage place over the deflector into a ball receiving container, they can again be transferred before the beginning of the next training session into the intermediate storage place.

BRIEF DESCRIPTION OF THE DRAWINGS

The invention is to be explained in greater detail hereinafter relative to one exemplary embodiment. In the drawings:

FIG. 1 is a top plan view of a tennis court including the ball retrieving system of the present invention.

FIGS. 5*a*, 5*b*, and 5*c* are simplified side views of a ball throwing machine standing on the tennis court as in FIG. 1 in three different phases of a retrieving arm moving through under the ball throwing machine.

FIG. 6 is a front vertical lengthwise section through a ball retriever mounted at the top of the tennis court as in FIG. 1.

FIG. 7 is a side vertical cross section through the ball retriever as in FIG. 6.

FIG. 8 is a cutaway portion of FIG. 7 in larger scale.

DETAILED DESCRIPTION OF THE PREFERRED EMBODIMENTS

Figure 2:
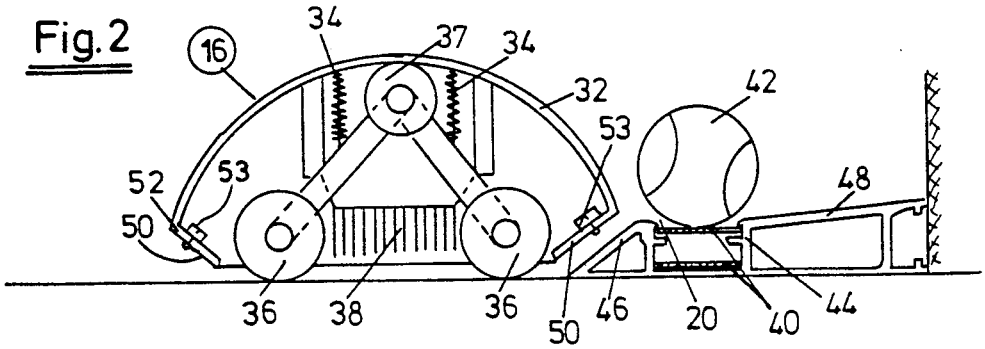
FIG. 2 is a cross section through a retrieving arm and a ball receiving channel on one lengthwise side of the tennis court as in FIG. 1.

The tennis court shown in FIG. 1 is divided in the traditional manner by a net 10 into two tennis court halves 12 and 14. In order to retrieve tennis balls lying on the left hand half 12 of the tennis court, a first retrieving arm 16 extends transverse to net 10 between net 10 and the left top of the tennis court. Arm 16 can be moved back and forth along net 10 between both of the side edges of the tennis court. In a corresponding manner a second retrieving arm 18 is arranged on the right half 14 of the tennis court, and can be moved back and forth independently of retrieving arm 16 between the side edges of the tennis court. During a tennis match or during training retrieving arms 16 and 18 are normally found in a rest position immediately at a side edge or at opposite side edges of the tennis court. There they lie either on the one side on a ball receiving channel 20 or on the other side on a ball receiving channel 22.

When during retrieval of the tennis balls one of the retrieving arms 16, 18 moves in transverse direction over one half of the tennis court and approaches one of the ball receiving channels 20 or 22, it drives the tennis balls lying on the ground in front of it forward and finally into the ball receiving channel 20 or 22 toward which it is moving in a straight line. In both of the ball receiving channels 20 and 22, the balls are transported to the left with reference to FIG. 1 to the top of the tennis court and at its corners pass over into a conveyor chute or trough 24. In chute 24, the balls are further transported to a ball retriever 26. From there the balls pass through an auxiliary tube 28 to a ball throwing machine 30 which is known in and of itself, which during tennis practice in the exemplary case shoots tennis balls out of the left half 12 of the tennis court into the right half 14 of the tennis court. As indicated in FIG. 1, auxiliary tube 28 is articulately connected to ball retriever 26 so that it can be swiveled together with the ball throwing machine 30 and thus can be moved to the side at the outermost top end of the tennis court when it is not in use.

Figure 3:
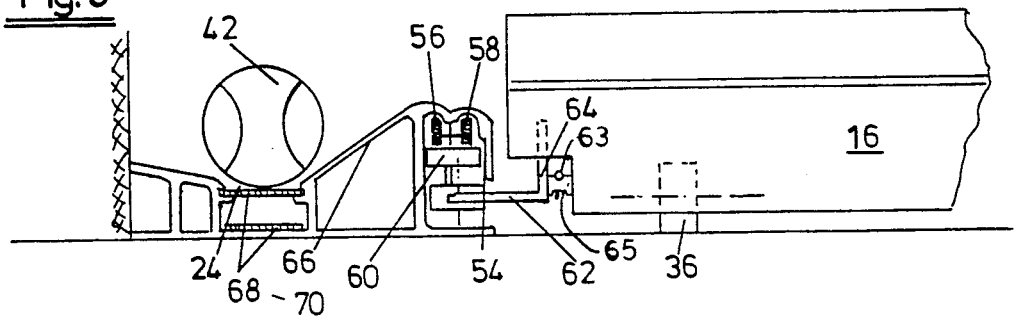
FIG. 3 is a cross section through a guide rail for a retrieving arm arranged at the top of the tennis court as in FIG. 1 and also through a conveyor channel for the collected tennis balls arranged adjacent thereto.
Figure 4:
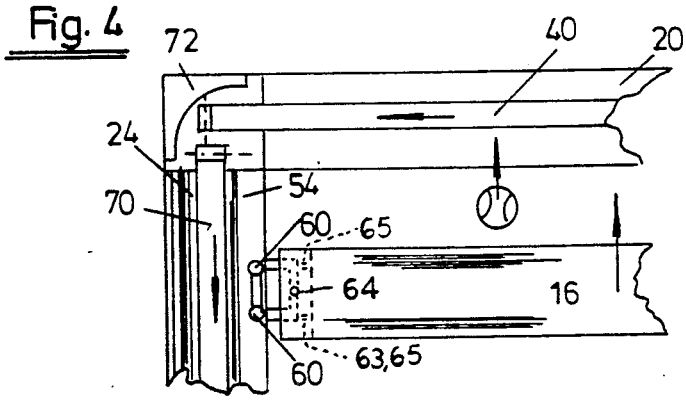
FIG. 4 is a plan view of one end of a retrieving arm and a ball receiving channel in larger scale than in FIG. 1.

Since retrieving arms 16 and 18 are of identical construction and are guided in the same manner, the next portion of the description relative to FIGS. 2 to 4 is limited to retrieving arm 16 in the left half 12 of the tennis court.

According to FIG. 2, retrieving arm 16 consists essentially of a light metal profile 32 rounded on the top so that impinging balls roll off. Light metal profile 32 rests under interposition of springs 34 on a plurality of pairs of traveling wheels 36 distributed over the length of the retrieving arm. When a person inadvertently touches retrieving arm 16, this arm as a result of the flexibility of springs 34 is not automatically displaced. All or at least a part of the pairs of traveling wheels 36 in turn are driven in either direction by an electric motor 37.

On its bottom, retrieving arm 16 can carry a brush 38 which is height adjustable. Thus, brush 38 can be thrust downward for instance by means of electromagnets into an oblique position engaging against the ground, in order to smooth the ground during movement of retrieving arm 16.

Only the ball receiving channel 20 is shown in FIG. 2. The opposite ball receiving channel 22 has the same cross section and construction. The bottom of ball receiving channel 20 includes an endless conveyor belt 40 which transports the tennis balls 42.

The sides of both the top and bottom portions of conveyor belt 40 are guided in a light metal profile 44. Profile 44 is formed in such a manner in cross section that an elevated portion is present on both sides of the top portions of conveyor belt 40, which prevents balls 42 from rolling away from conveyor belt 40. In the direction toward the middle of the tennis court, profile 44 has a downwardly inclined oblique surface 46. A rising oblique surface or member 48 is connected to the outside or ball receiving channel 20, which member 48 is longer than the diameter of a tennis ball 42.

During a retrieval process when retrieving arm 16 approaches ball receiving channel 20, it drives the balls 42 before it and over the oblique surface 46 onto conveyor belt 40 in ball receiving channel 20. When many balls are packed tightly together, some then will be shoved ahead of the others onto conveyor belt 40. Then, when the pursuing balls which are applying the shoving pressure are themselves shoved over oblique surface 46 into ball receiving channel 20, the initial balls can be deflected and turn aside or pushed up onto oblique surface 48. From there they roll back onto the receiving channel 20 when the balls 42 there have been transported away.

As shown in FIG. 2, profile 32 of retrieving arm 16 is configured on its side in the bottom area with an oblique countersurface 50 which is turned downward and springs back inward. The angle of inclination of countersurface 50 corresponds to the angle of inclination of oblique surface 46. The distance of the top edge 52 of countersurface 50 from the ground of the tennis court is less than half the diameter of a tennis ball 42, so that tennis balls cannot be clamped or trapped between countersurface 50 and the ground.

Retrieving arm 16 moves forward until it engages receiving channel 20 or on the other side moves forward until it engages receiving channel 22, and in turn the countersurface 50 engages flat against oblique surface 46. Then the limit switches 53 applied to countersurface 50 can be operated, whereby electric motors 37 are disconnected.

Retrieving arms 16, 18 could be controlled at both of their ends. Then, however, cumbersome guide rails are needed under net 10, and the possibility also exists that a retrieving arm could become locked in by an oblique setting or inclination between the two guides. In the preferred embodiment then, a single guide rail 54 extends along each top of the tennis court. The guide rail has essentially a section which turns outward, is open to the playing field, and is of reversed U-shape. In the inside of guide rail 54 is found a third rail or contact rail 56, on which slides along a current collector 58 applied to retrieving arm 16. This is connected by electric cable with electric motors 37. In guide rails 54 are also located two guide or contact rollers 60 (see FIG. 4), which are mounted on retrieving arm 16 by means of an assembly 62 of linkage rods. Linkage rods assembly 62 with guide or contact rollers 60 forms an inflexible unit in and of itself. This unit is supported pivotally on retrieving arm 16 around a vertical pivot axis 64, and the unit is resiliently urged by springs 65 to be parallel to arm 16 (a zero pivot angle). The relative setting or the pivot angle between linkage rod assembly 62 and retrieving arm 16 is sensed by a sensor 63. Then, when the pivot angle exceeds a certain measure in one or the other direction, electric motors 37 of the different pairs of traveling wheels 36 are driven with different velocity in such a manner that the retrieving arm 16 is once again aligned perpendicularly to guide rail 54 (and parallel to the unit).

Guide rail 54 on the left top of the tennis court with reference to FIG. 1 is configured in one piece with a light metal profile 66, which represents conveyor trough or chute 24. On the opposite end of the tennis court a simple light metal profile can be used as guide rail 54 for retrieving arm 18, because at that site no conveyor trough or chute for tennis balls is needed.

On each side of ball retriever 26, the base of conveyor chute or trough 24 in turn forms another endless conveyor belt 68 or 70 (see FIG. 6). Both conveyor belts 68, 70 are guided in the same manner, as shown in FIG. 3, into profile 66. Both conveyor belts 68 and 70, however, convey into opposite sides, so that tennis balls 42 in turn are transported inward from the corners of the tennis court to ball retriever 26. The balls thus cannot roll away from conveyor belts 68, 70 since profile 66 includes rising oblique surfaces on both sides of the conveyor belts according to FIG. 3.

Deflectors 72 suffice to conduct the tennis balls over from the conveyor belt 40 of ball receiving channel 20 onto conveyor belt 70 of ball conveyor channel 24 by subjecting the tennis balls arriving at the end of conveyor belt 40 to a direction modification in their transfer to conveyor belt 70. Alternatively, it would be possible to arrange another conveyor belt above the ends of the two conveyor belts 40 and 70 and oblique in regard to belts 40 and 70, which would carry the balls over from conveyor belt 40 to conveyor belt 70. The transfer can also be simplified in that the top of conveyor belt 70 is found on a somewhat lower plane than the top of conveyor belt 40.

FIGS. 5*a*, 5*b*, and 5*c* show how during the retrieval process retrieving arm 16 is moved under ball throwing machine 30. Sensors or contact switches 74, 76 in this case sense the position of retrieving arm 16. Normally the ball throwing machine 30 rests on inner support wheels or jackwheels 78. When retrieving arm 16 reaches the first sensor 74, additional outside support wheels or jackwheels 80 are moved down against the ground and then immediately the inside support wheels 78 are drawn up. When the retrieving arm 16 is then moved through under inside support wheels or jackwheels 78 as far as beneath the second sensor 76, inside support wheels or jackwheels 78 are again lowered and outside support wheels or jackwheels 80 are raised.

Ball retriever 26 has a relatively narrow, high housing, which in its bottom area includes an intermediate storage area 82 and in its top area a final storage place 84 for tennis balls. The tennis balls which are transported on conveyor belt 68 are guided through a first guide device 86 to a first vertical conveyor 88, which consists of two parallel, vertically arranged conveyor belts. Vertical conveyor 88 picks up the tennis balls by friction locking and releases them at the top end of the intermediate storage place 82. In a corresponding manner the tennis balls transported by conveyor belt 70 are then guided through a guide device 90 to a second vertical conveyor 92, which transports the balls likewise upward into intermediate storage place 82.

Intermediate storage place 82 has an oblique base or a conveyor belt arranged at its base, so that the balls coming into the intermediate storage place are slid to the bottom of a third vertical conveyor 94, which likewise consists of two parallel, vertically arranged conveyor belts. Vertical conveyor 94 transports the balls at the top end of ball retriever 26 to a pivotal deflector 96 shown in FIG. 8, which can occupy three different positions by means of an electric control. In a first position, shown in solid lines in FIG. 8, the balls are guided at that point by the vertical conveyor into the auxiliary tube 28 of ball throwing machine 30. In a second position, indicated by direction arrow 96' in FIG. 8, the balls drop out of deflector 96 into final storage place 84. In a third position, shown by direction arrow 96" in FIG. 8, the deflector 96 deflects the balls into a tube 98, which leads to a ball basket 100 which is either tightly or detachably attached to the outside of the housing of ball retriever 26. A ball counter or recorder 97 is mounted on deflector 96, which is connected with a control device for the driving of vertical conveyor 94 and which provides that any further desired number of balls be fed through tube 98 to the outside into ball basket 100.

Between final storage place 84 and intermediate storage place 82 located therebeneath, there is found for instance an electrically powered or electromagnetically powered opening and closing trap door 102. Trap door 102 is opened at the beginning of a training hour, so that the predetermined number of tennis balls contained in final storage place 84 drops into intermediate storage place 82. From intermediate storage place 82, the balls can then be guided by means of vertical conveyor 94 and deflector 96 selectively through auxiliary tube 28 of ball throwing machine 30 or through tube 98 to ball basket 100 for removal from there. At the end of the training hour then when trap door 102 is closed, final storage place 84 is again filled with tennis balls, and these balls are thus counted at deflector 96. On account of the described properties of ball retrievers 26, they are suitable to be equipped with a control mechanism operated by coin or token. Thus, disconnection can occur either following lapse of a certain length of time or following discharge of a certain number of balls, and for instance is indicated by a signal light at the end showing whether all of the tennis balls have again reached final storage place 84.

Figure 9:
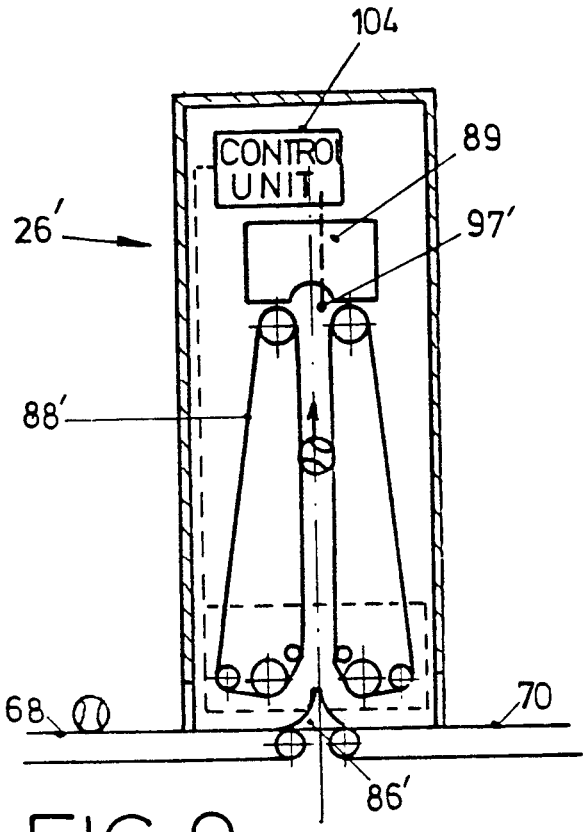
FIG. 9 is a front vertical lengthwise section through an alternative embodiment of a ball retriever mounted at the top of the tennis court.
Figure 10:
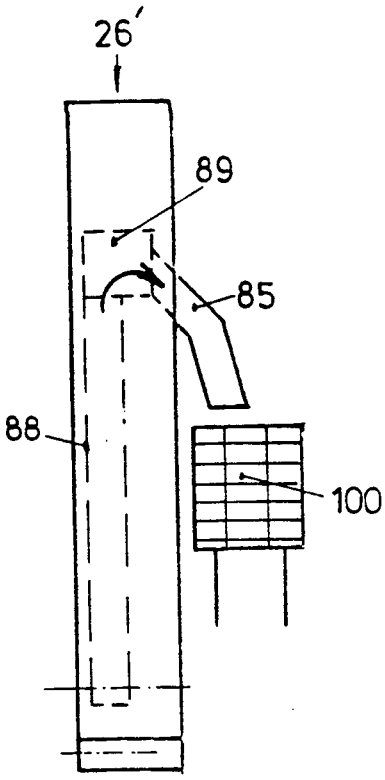
FIG. 10 is a side vertical cross section through the ball retriever as in FIG. 9.

An alternative embodiment of a ball retriever 26' which is a simpler version of ball retriever 26 is depicted in FIGS. 9 and 10. As shown, ball retriever 26' includes a guide device 86' which is shaped to guide tennis balls received from both conveyor belts 68 and 70 into a vertical conveyor 88'. At the top of vertical conveyor 88', a guide device 89 guides the tennis balls to a chute 85. Chute 85 is designed to receive a hanging ball basket 100 therebeneath and into which tennis balls from vertical conveyor 88' flow by gravity. A sensor 97' is provided adjacent guide device 89 to count the tennis balls passing thereby. Sensor 97' is connected to a control unit 104. Control unit 104 is used to control the operation of vertical nveyor 88' and count the number of tennis balls passing sensor 97' so that a predetermined number of balls are lifted from conveyor belts 68 and 70 into ball basket 100. If desired, ball retriever 26' could be provided with a pair of vertical conveyors in the same manner as ball retriever 26.

Figure 11:
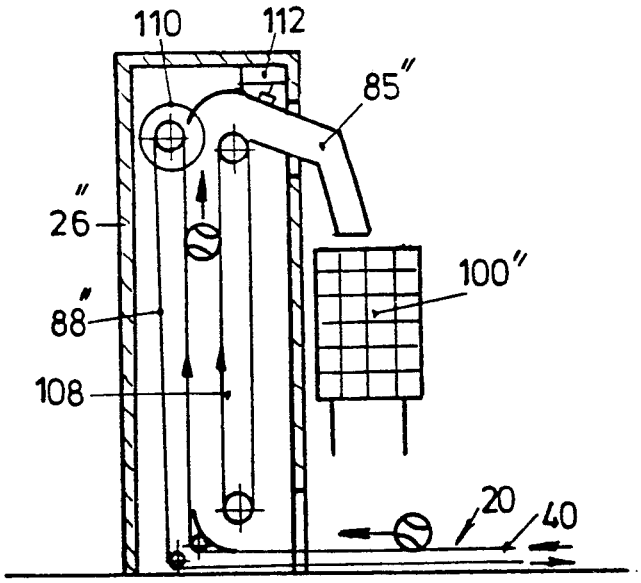
FIG. 11 is a front vertical lengthwise section through another alternative embodiment of a ball retriever mounted at each top side of the tennis court.

Still another alternative embodiment of a ball retriever 26" is depicted in FIG. 11. In this embodiment, a separate ball retriever 26" is provided for each channel 20, 22, with the ball retriever 26" for channel 20 depicted in FIG. 11. With ball retriever 26", conveyor belt 40 runs directly into ball retriever 26" and forms one-half of the lifting conveyor 88" as shown. In this embodiment, conveyor belt 40 is driven by a motor 110 controlled by a control unit 112. As shown, motor 110 also drives through a suitable connection, the other lifting conveyor belt 108. A guide device 86" is provided at the position where conveyor belt 40 turns upwards to help deflect tennis balls carried along conveyor belt 40 into contact with conveyor 88". At the top of conveyor 88", tennis balls lifted thereby are directed into a chute 85" to be delivered to a basket 100" hanging from ball retriever 26".

With ball retriever 26", it should be appreciated that conveyor belts 68 and 70 are omitted. Then, during the actuation of arm 16 toward channel 20 or 22, the conveyor belt 40 located in that channel is actuated to collect all of the tennis balls driven thereto and to deliver the tennis balls to basket 100" provided at the end of that channel. It should also be appreciated that this system is less complicated than those described above, as conveyor belt 40 is used not only to move the balls along the channel but as part of lifting conveyor 88" and as the same motor which drives conveyor belt 40 also drives conveyor belt 108.

It is to be understood that ball retrievers 26, 26' or 26", as described above with reference to FIGS. 6 to 11, can also be used in connection with a retriever arm being moved and guided in some other manner. For example, when the tennis balls are guided only from one single side into ball retriever 26, one of the two vertical conveyors 88, 92 can be deleted. Also the embodiment of a ball throwing machine described relative to FIG. 5, under which a retrieving arm can be moved, is only appropriate for use with a retrieving arm which moves along the net. However, such a ball throwing machine could function in a corresponding manner even when a retrieving arm is being moved some other direction over the tennis court. It is advantageous to have auxiliary tube 28 of ball throwing machine 30 configured telescopically, so that the ball throwing machine can be arranged at a more or less great distance from the top of the tennis court.

I claim:

1. A system for retrieving tennis balls resting on one half of a tennis court comprising:

an elongate retrieving arm movable transverse to its longitudinal axis over a surface of the tennis court, said retrieving arm (16, 18) extending longitudinally at least one half (12, 14) of the tennis court and having the longitudinal axis transverse to a net of the tennis court and one end thereof immediately adjacent the net (10) of the tennis court whereby said retrieving arm is moved in a direction parallel to the net to push tennis balls on the half of the tennis court to one side of the tennis court, and means for reciprocally moving said retrieval arm over the court surface;

respective shallow ball receiving channels (20, 22) arranged on each respective longitudinal side of the tennis court, said retrieving arm being alternately moved between said receiving channels so as to thrust the balls into the ball receiving channel toward which said retrieving arm is moved; and a ball transportation means for moving the balls in said ball receiving channels to a top of the tennis court.

2. A system as claimed in claim 1, characterized in that endless conveyor belts (40) are guided in the ball receiving channels (20, 22) so that the tennis balls (42) can be transported to a top of the tennis court.

3. A system as claimed in claim 2, characterized in that the ball receiving channels (20, 22) have connections on the top of the tennis court to conveyor belts (68, 70) extending along a top end, through which the tennis balls (42) can be transported to a ball retriever (26).

4. A system as claimed in claim 1, characterized in that the ball collecting channels (20, 22) have a shallow descending outside oblique surface (46) on the side turned toward the retrieving arm (16, 18) and that an outside profile of the retrieving arm (16, 18) has bottom countersurfaces (50) along the side edges which extend essentially with the same angle of inclination as the oblique surface (46) and of which the top edge is lower than half the diameter of a tennis ball (42).

5. A system as claimed in claim 4, characterized in that the ball receiving channels (20, 22) on the side turned away from the retrieving arm (16, 18) have a shallow rising oblique surface (48) which is broader than the diameter of a tennis ball (42).

6. A system for retrieving tennis balls resting on one half of a tennis court comprising: an elongate retrieving arm movable transverse to its longitudinal axis over a surface of the tennis court, said retrieving arm (16, 18) extending longitudinally at least one half (12, 14) of the tennis court and having the longitudinal axis transverse to a net of the tennis court and one end thereof immediately adjacent the net (10) of the tennis court whereby said retrieving arm is moved in a direction parallel to the net to push tennis balls on the half of the tennis court to one side of the tennis court, said retrieving arm including an electrical contact at a top end theerof and at least one electric drive motor driving traveling wheels (36) of the retrieving arm (16, 18); and further including a guide rail (54) extending along a baseline end of the tennis court to which is mounted the top end of said retrieving arm, said guide rail (54) extending along a baseline end of the tennis court to which is mounted the top end of said retrieving arm, said guide rail including at least one contact rail (56) which makes electrical connection with said electrical contact (38) of said retrieving arm (16, 18).

7. A system as claimed in claim 6, characterized in that a sensor means is mounted on the retrieving arm (16, 18) for scanning the angle between the retrieving arm (16, 18) and the guide rail (54) and for providing control signals indicative thereof; and a plurality of drive motors (37) driving traveling wheels (36) of the retrieving arm (16, 18), said drive motors being controlled with different velocity depending on the received control signals of said sensor means in such a manner tha certain tolerance limits a certain angle is maintained between the guide rail (54) and the retrieving arm 16, 18).

8. A system as claimed in claim 6, characterized in that at least two limit switches (53) are mounted in the retrieving arm (16, 18) on opposite longitudinal sides thereof, which switches are respectively operated at respective end positions of movement of the retrieving arm (16, 18) by engagement against a respective ball receiving channel (20, 22).

9. A system as claimed in claim 6, characterized in that the guide rail (54) includes a conveyor chute (24) in which conveyor belts (68, 70) are movably mounted, by which tennis balls guided onto the conveyor belts (68,70) can be transported into a ball retriever (26).

* * * * *